US008944769B2

(12) United States Patent
Olsen et al.

(10) Patent No.: US 8,944,769 B2
(45) Date of Patent: Feb. 3, 2015

(54) BLADE ASSEMBLY WITH IMPROVED JOINT STRENGTH

(75) Inventors: Steven Olsen, Wooster, OH (US); Rolf A. Mueller, Wooster, OH (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 878 days.

(21) Appl. No.: 12/970,304

(22) Filed: Dec. 16, 2010

(65) Prior Publication Data

US 2011/0150656 A1 Jun. 23, 2011

Related U.S. Application Data

(60) Provisional application No. 61/288,522, filed on Dec. 21, 2009.

(51) Int. Cl.
*F01D 5/30* (2006.01)
*F01D 5/32* (2006.01)

(52) U.S. Cl.
CPC ..... *F01D 5/323* (2013.01); *F05D 2230/237* (2013.01); *F05D 2230/60* (2013.01)
USPC ..... 416/197 C; 416/213 R

(58) Field of Classification Search
CPC F01D 5/323; F05D 2230/237; F05D 2230/60
USPC ..... 416/197 C, 197 B, 213 A
See application file for complete search history.

(56) References Cited

U.S. PATENT DOCUMENTS

| | | | | |
|---|---|---|---|---|
| 5,065,509 | A * | 11/1991 | Sahashi | 29/889.21 |
| 5,794,436 | A * | 8/1998 | Maeda | 60/367 |
| 2005/0103005 | A1 * | 5/2005 | Turner | 60/330 |
| 2008/0308373 | A1 | 12/2008 | Wiegert | |
| 2009/0000289 | A1 | 1/2009 | Wiegert et al. | |

OTHER PUBLICATIONS

Belohlav, Alan; "Understanding Brazing Fundamentals"; Sep. 2000; American Welding Society; The American Welder—Sep./Oct. 2000; www.aws.org/wj/amwelder/9-00/fundamentals.html.*

* cited by examiner

*Primary Examiner* — Nathaniel Wiehe
*Assistant Examiner* — Jeffrey A Brownson
(74) *Attorney, Agent, or Firm* — Simpson & Simpson, PLLC

(57) ABSTRACT

A blade assembly for a torque converter including a shell with an inner surface and a plurality of blades attached to the shell by brazing. Each blade has a first surface for guiding a fluid in the torque converter and a second surface substantially parallel to the inner surface. The blades may include sheet steel and may be made by stamping. In an example embodiment of the invention, each blade includes at least one tab, the shell comprises a plurality of slots or indents, and the at least one tab is disposed in a respective slot or indent. The shell may be an outer shell or a core ring for a pump or turbine for the torque converter.

3 Claims, 7 Drawing Sheets

BLADE ASSEMBLY WITH IMPROVED JOINT STRENGTH

CROSS-REFERENCE TO RELATED APPLICATIONS

This application claims the benefit under 35 U.S.C. §119 (e) of U.S. Provisional Application No. 61/288,522 filed Dec. 21, 2009.

FIELD OF THE INVENTION

The invention relates generally to a torque converter, and more specifically to a blade assembly with improved braze joint strength for the torque converter.

BACKGROUND OF THE INVENTION

Torque converters include shells and blades to direct fluid flow. Commonly assigned United States patent application publication number 2008/0308373 describes a blade surface with tabs arranged to conform to an inner surface of the shell to provide a fluid seal. United States patent application publication number 2009/0000289 describes a blade with an edge shaped so that at least a portion of the edge can be inserted into a depression in the internal surface of the shell with which it is to be connected. U.S. Pat. No. 5,794,436 assigned to Aisin AW Co., Ltd., describes a pump impeller and a turbine runner with inclined blades having edge portions bent to form right angle connections to shells and cores of the pump impeller and the turbine runner.

The following description is made with reference to 2-4. FIG. 2 is a back view of a prior art impeller assembly shown without brazing for clarity. FIG. 3 is a partial section view of the impeller assembly of FIG. 2 taken generally along line 3-3 in FIG. 2. FIG. 4 is a detail view of encircled region 4 in FIG. 3 shown with brazing. Prior art blade 116 is attached to shells 112 and 114 by braze material. Blade 116 may be attached to shell 112 by braze material 130 and 131, for example. Materials 130 and 131 may be a copper paste melted and bonded to blade 116 and shells 112 and 114 by brazing in a brazing furnace, although other methods and processes are possible. As is known in the art, the strength of a brazing joint is dependent on the gap filled by the braze material. Smaller gaps are desirable as they result in a stronger joint.

A joint area of prior art blade 116 to shell 112 includes gaps 132 and 133 filled by braze material 130 and 131, respectively. Gap 133 is considerably larger than gap 132. Blade thickness 134 is measured between fluid guiding surface 140 and parallel surface 141. As can be appreciated from FIG. 4, as blade thickness 134 is increased or blade to shell angle 136 is decreased, height of surface 138 from shell 112 is increased, thereby increasing gap 133.

BRIEF SUMMARY OF THE INVENTION

Example aspects of the present invention broadly comprise a blade assembly for a torque converter including a shell with an inner surface and a plurality of blades attached to the shell by brazing. Each blade has a first surface for guiding a fluid in the torque converter and a second surface substantially parallel to the inner surface. The blades may include sheet steel and may be made by stamping. In an example embodiment of the invention, each blade includes at least one tab, the shell includes a plurality of slots or indents, and the at least one tab is disposed in a respective slot or indent. The shell may be an outer shell or a core ring for a pump or turbine for the torque converter.

In an example embodiment of the invention, the second surface is substantially orthogonal to the first surface. In some example embodiments of the invention, each blade includes an end portion including a portion of the first surface, the second surface, and a third surface, and the second surface forms a chamfer between the first and third surfaces. In an example embodiment of the invention, each blade includes at least one tab extending from the end portion, the shell includes a plurality of slots or indents, and the at least one tab is disposed in a respective slot or indent.

Other example aspects of the invention broadly comprise a blade assembly for a torque converter including a shell with an inner surface and a plurality of blades attached to the shell by brazing. Each blade in the plurality of blades has a first surface for guiding fluid in the torque converter and a second surface parallel to the first surface. The first and second surfaces define a thickness for the blade. Each blade also includes an end portion with respective portions of the first and second surfaces, a coined surface extending from the first surface and substantially parallel to the inner surface, and a third surface connecting the coined surface to the second surface.

In an example embodiment of the invention, a juncture of the third and coined surfaces is about midway through the thickness of said each blade. In an example embodiment of the invention, an angle measured between the first surface and the coined surface is substantially equal to an angle measured between the first surface and the shell.

Other example aspects of the invention broadly comprise a blade assembly for a torque converter including a shell with an inner surface and a plurality of blades attached to the shell by brazing. Each of the blades in the plurality of blades has a first surface for guiding fluid in the torque converter, a second surface offset from and parallel to the first surface, and a third surface parallel to the inner surface. The third surface connects an edge of the first surface with an edge of the second surface. In an example embodiment of the invention, each blade is bent proximate the shell.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers appearing in different drawing views identify identical, or functionally similar, structural elements. Furthermore, it is understood that this invention is not limited only to the particular embodiments, methodology, materials and modifications described herein, and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 1A:
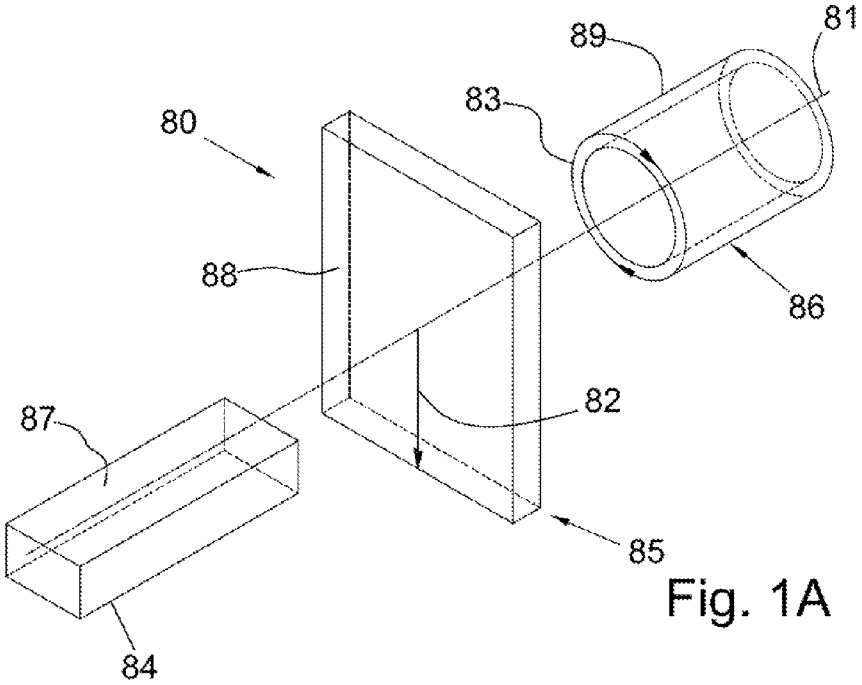
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
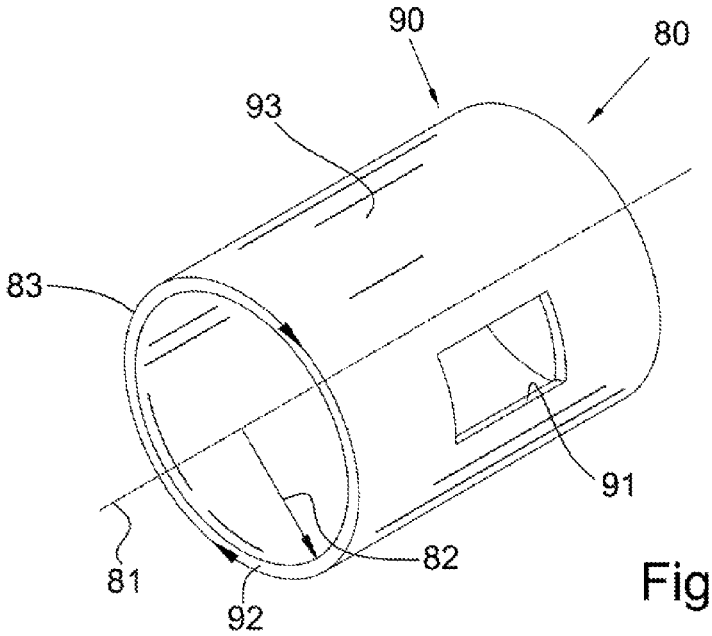
FIG. 1B is a perspective view of an object in the cylindrical coordinate system of FIG. 1A demonstrating spatial terminology used in the present application.
Figure 2:
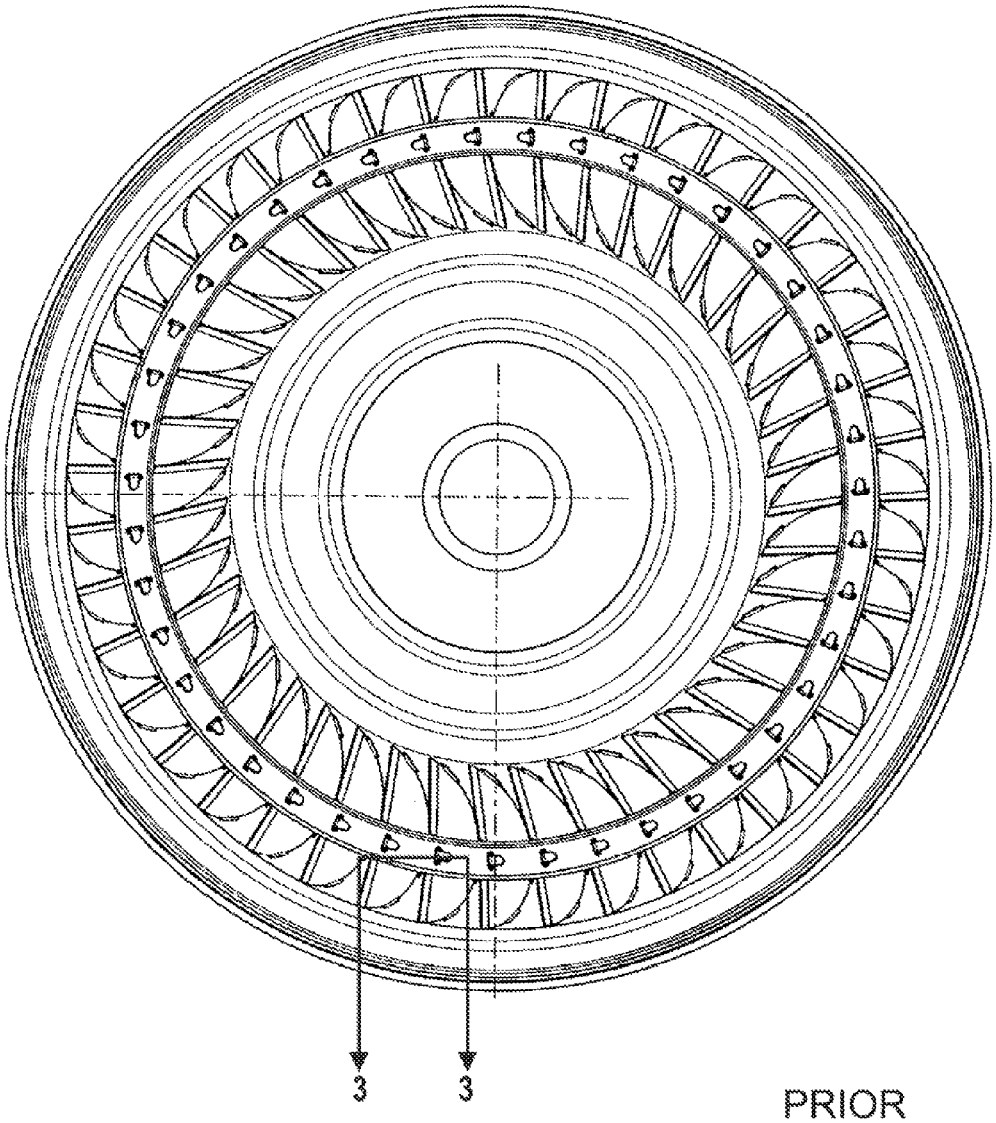
PRIOR ART Fig. 2
FIG. 2 is a back view of a prior art impeller assembly shown without brazing for clarity.
Figure 3:
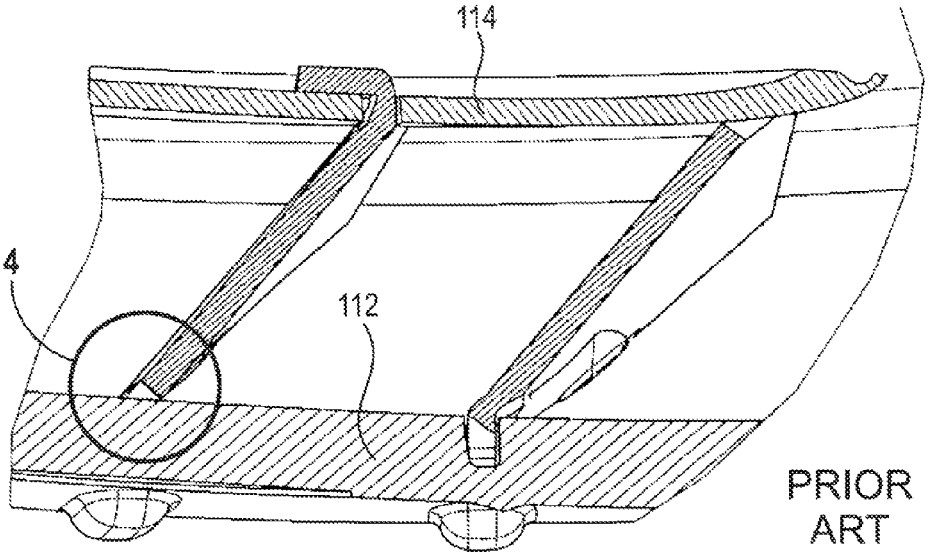
FIG. 3 is a partial section view of the impeller assembly of FIG. 2 taken generally along line 3-3 in FIG. 2.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is part of a circumferential plane.

Figure 5:
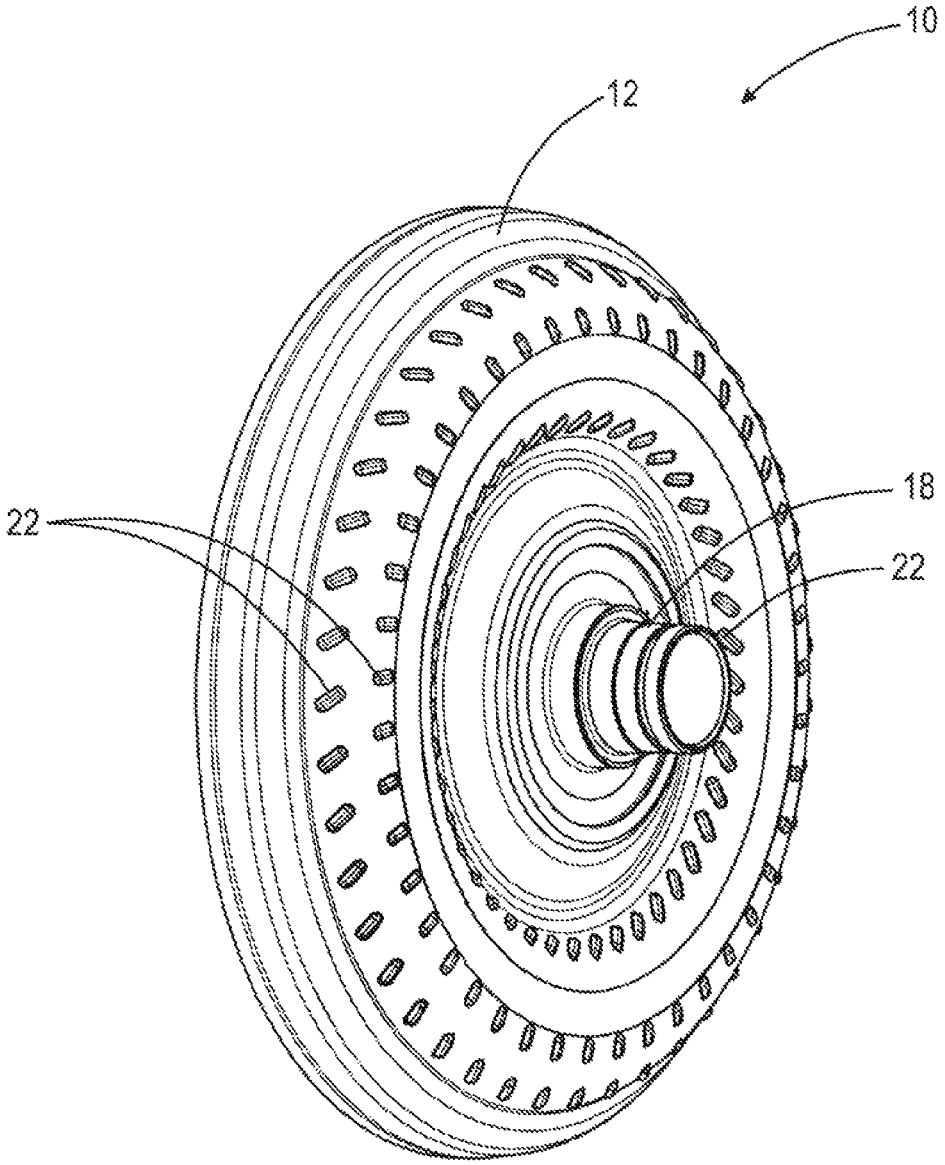
FIG. 5 is a perspective view of an impeller assembly for a torque converter, according to an example embodiment of the invention.
Figure 7:
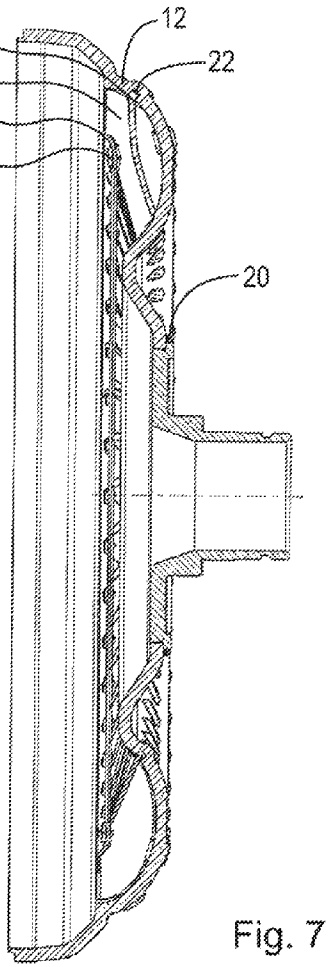
FIG. 7 is a section view of the impeller assembly of FIG. 5 taken generally along line 7-7 in FIG. 6.
Figure 6:
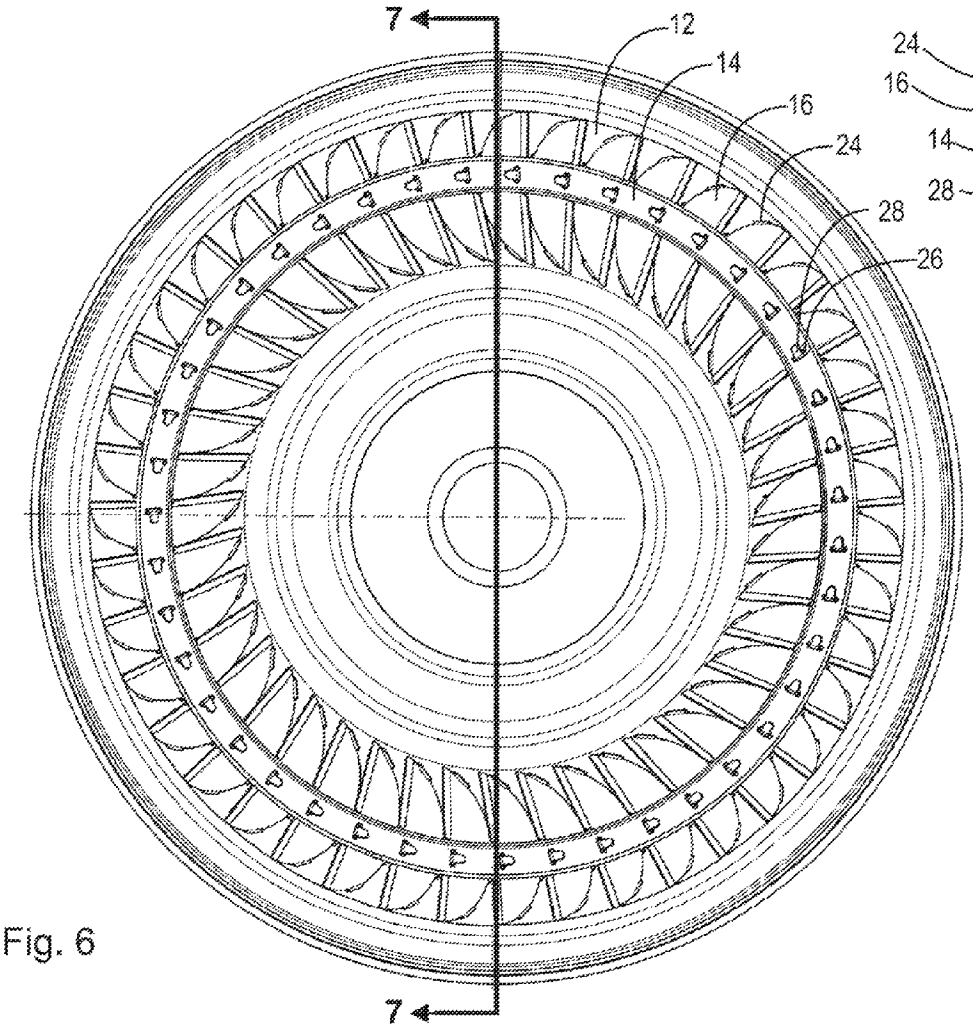
FIG. 6 is a back view of the impeller assembly of FIG. 5 shown without brazing for clarity.
Figure 8:
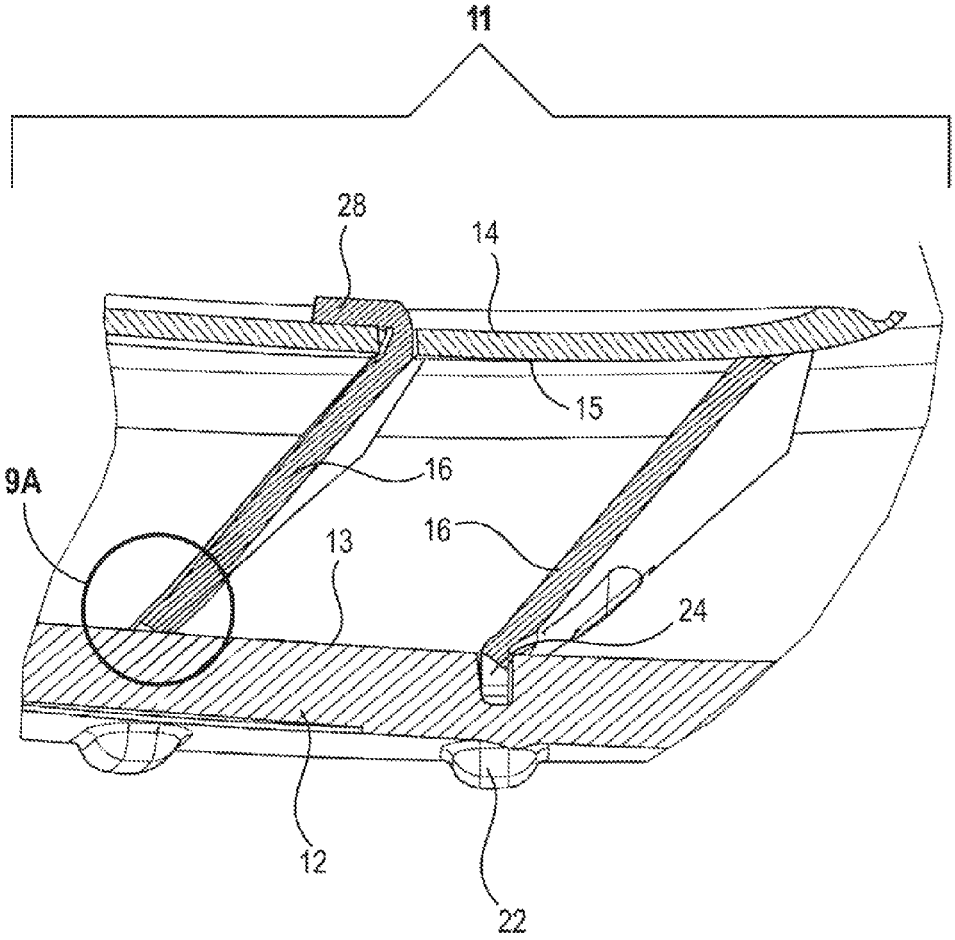
FIG. 8 is a partial section view of the impeller assembly of FIG. 5 taken generally along line 8-8 in FIG. 6.

The following description is made with reference to FIGS. 5-8. FIG. 5 is a perspective view of an impeller assembly for a torque converter. FIG. 6 is a back view of the impeller assembly of FIG. 5 shown without brazing for clarity. FIG. 7 is a section view of the impeller assembly of FIG. 5 taken generally along line 7-7 in FIG. 6. FIG. 8 is a partial section view of the impeller assembly of FIG. 5 taken generally along line 8-8 in FIG. 6. Impeller assembly 10 generally includes blade assembly 11 having shells 12 and 14, and blades 16. In an example embodiment of the invention, shell 12 is an outer shell and shell 14 is a core ring for impeller assembly 10. Shell 12 includes inner surface 13 and shell 14 includes inner surface 15. Impeller assembly 10 also includes impeller hub 18. Although impeller hub 18 is shown as a separate component fixedly connected to outer shell 12 at weld 20, in some embodiments of the invention (not shown), hub 18 may be integral to shell 12.

Shell 12 includes indents 22 for receiving outside tabs 24 of blades 16. Core ring 14 includes slots 26 for receiving inside tabs 28 of blades 16. Although a particular number of indents 22 and outside tabs 24, and slots 26 and inside tabs 28, are shown, any number of indents, slots, and tabs may be present so long as blade 16 is properly positioned and retained in shells 12 and 14. Furthermore, in some example embodiments of the invention (not shown), shell 12 may be a shell for a turbine assembly (not shown) for the torque converter comprising slots (not shown) in place of indents 22. In an example embodiment of the invention, blades 16 are made from sheet steel in a stamping process.

Figure 9A:
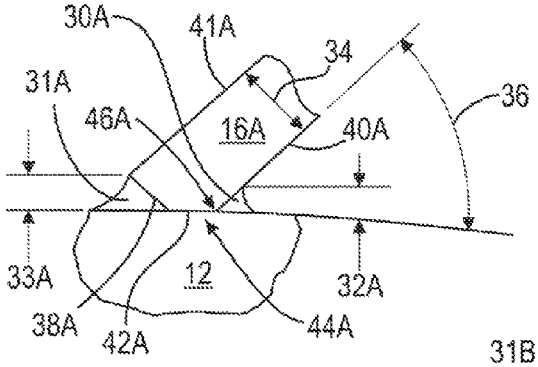
FIG. 9A is a detail view of encircled region 9A in FIG. 8 showing a chamfered blade with brazing, according to an example aspect of the invention.

The following description is made with reference to FIG. 9A. FIG. 9A is a detail view of encircled region 9A in FIG. 8 showing a chamfered blade with brazing, according to an example aspect of the invention. Blade 116 is attached to shells 12 and 14 by braze material. Blade 16A may be attached to shell 12 by braze material 30A and 31A, for example.

In some example embodiments of the invention, blade 16A includes surface 40A for guiding the fluid in the torque converter. Blade 16A also comprises surface 38A and coined, or chamfered, surface 42A forming end portion 44A. Surface 40A and end portion 44A share common edge 46A. Coined surface 42A is arranged to be substantially parallel to shell 12. That is, angle 36 measured between surface 40A and shell 12 is substantially equal to an angle measured between surface 40A and coined surface 42A.

Figure 4:
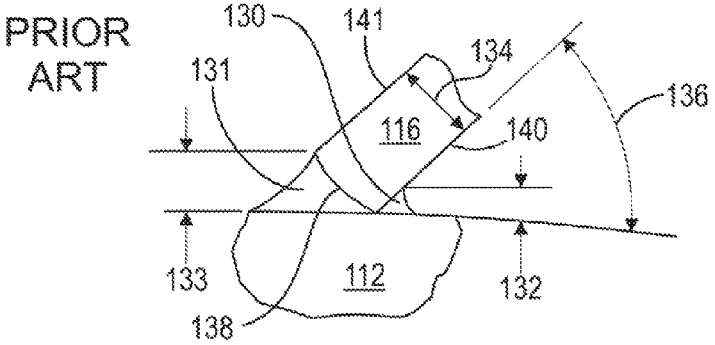
FIG. 4 is a detail view of encircled region 4 in FIG. 3 shown with brazing.

In an example embodiment of the invention shown in FIG. 9A, coined surface 42B forms a chamfer between surface 40A and surface 38A. Blade thickness 34 is measured between fluid guiding surface 40A and parallel surface 41A. Coined surface 42A terminates on surface 38A. In an example embodiment of the invention, coined surface 42A terminates on surface 38A approximately midway through thickness 34, or midway between surfaces 40A and 41A. That is, a juncture of the surfaces 38A and 42A is about midway through thickness 34 of blade 16A. A joint area of blade 16A to shell 12 includes gaps 32A and 33A filled by braze material 30A and 31A, respectively. As can be appreciated from the figures, gap 33A in FIG. 9A is less than gap 133 in FIG. 4 for blade 16A with thickness 34 equal to thickness 134 and angle 36 equal to thickness 136. As stated supra, smaller gaps 32A and 33A provide improved joint strength for blade 16A.

Figure 9B:
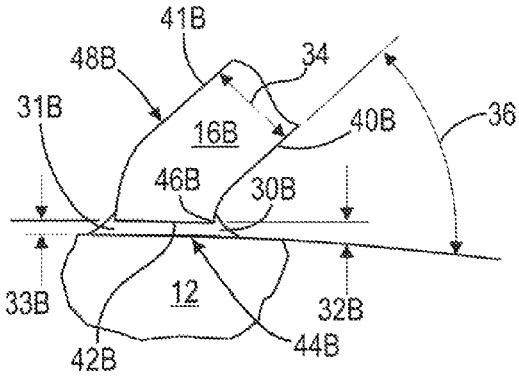
FIG. 9B is an alternative embodiment of encircled region 9A in FIG. 8 showing a bent and chamfered blade with brazing, according to an example aspect of the invention.

The following description is made with reference to FIG. 9B. FIG. 9B is an alternative embodiment of encircled region 9A in FIG. 8 showing a bent and chamfered blade with brazing, according to an example aspect of the invention. Blade 16B is attached to shells 12 and 14 by braze material. Blade 16B may be attached to shell 12 by braze material 30B and 31B, for example.

In some example embodiments of the invention, blade 16B includes surface 40B for guiding the fluid in the torque converter. Blade 16B also comprises coined, or chamfered, surface 42B forming end portion 44B. Surface 40B and end portion 44B share common edge 46B. Coined surface 42B is arranged to be substantially parallel to shell 12. That is, angle 36 measured between surface 40B and shell 12 is substantially equal to an angle measured between surface 40B and coined surface 42B. Coined surface 42B is not orthogonal to surface 40B, so surface 42B is longer the surface 138 in FIG. 4.

In an example embodiment of the invention shown in FIG. 9B, surface 40B includes bent portion 48B proximate shell 12. A joint area of blade 16B to shell 12 includes gaps 32B and 33B filled by braze material 30B and 31B, respectively. Blade thickness 34 is measured between fluid guiding surface 40B and parallel surface 41B. As can be appreciated from FIG. 9B, gaps 32B and 33B in FIG. 9B are less than gaps 132 and 133 in FIG. 4 for blade 16B with thickness 34 equal to thickness 134 and angle 36 equal to angle 136.

Figure 9C:
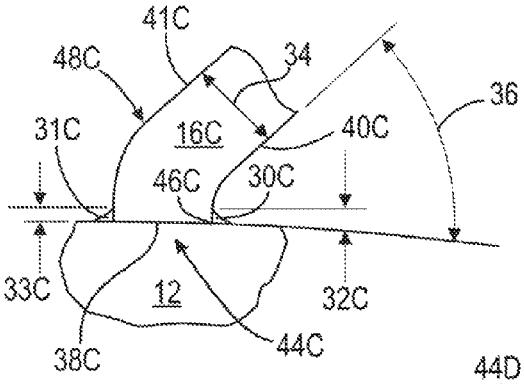
FIG. 9C is an alternative embodiment of encircled region 9A in FIG. 8 showing a bent blade with brazing, according to an example aspect of the invention.

The following description is made with reference to FIG. 9C. FIG. 9C is an alternative embodiment of encircled region 9A in FIG. 8 showing a bent blade with brazing, according to an example aspect of the invention. Blade 16C is attached to shells 12 and 14 by braze material. Blade 16C may be attached to shell 12 by braze material 30C and 31C, for example.

In some example embodiments of the invention, blade 16C includes surface 40C for guiding the fluid in the torque converter. Blade 16C also comprises surface 38C forming end portion 44C. Surface 40C and end portion 44C share common edge 46C. Surface 38C is arranged to be substantially parallel to shell 12. That is, angle 36 measured between surface 40C and shell 12 is substantially equal to an angle measured between surface 40C and surface 38C.

In an example embodiment of the invention shown in FIG. 9C, surface 40D includes bent portion 48C proximate shell 12 so that surface 38C is substantially orthogonal to bent portion 48C of surface 40C. A joint area of blade 16C to shell 12 includes gaps 32C and 33C filled by braze material 30C and 31C, respectively. Blade thickness 34 is measured between fluid guiding surface 40C and parallel surface 41C. As can be appreciated from FIG. 9C, gaps 32C and 33C in FIG. 9C are less than gap 132 and 133 in FIG. 4 for blade 16C with thickness 34 equal to thickness 134 and angle 36 equal to thickness 136.

Figure 9D:
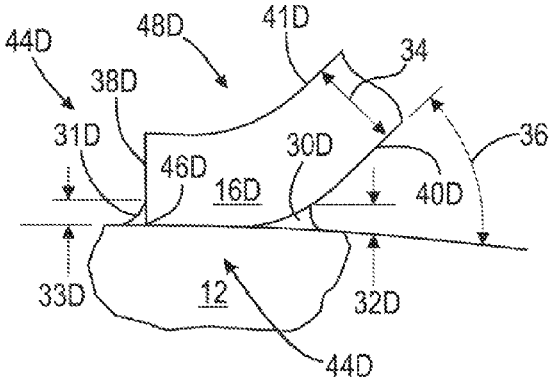
FIG. 9D is an alternative embodiment of encircled region 9A in FIG. 8 showing a flattened blade with brazing, according to an example aspect of the invention.

The following description is made with reference to FIG. 9D. FIG. 9D is an alternative embodiment of encircled region 9A in FIG. 8 showing a flattened blade with brazing, according to an example aspect of the invention. Blade 16D is attached to shells 12 and 14 by braze material. Blade 16D may be attached to shell 12 by braze material 30D and 31D, for example.

In some example embodiments of the invention, blade 16E includes surface 40D for guiding the fluid in the torque converter. Blade 16D also comprises surface 38D forming end portion 44D. Surface 40D and end portion 44D share common edge 46D. Surface 38D is arranged to be substantially perpendicular to shell 12.

In an example embodiment of the invention shown in FIG. 9D, surface 40D includes bent portion 48D proximate shell 12. A joint area of blade 16D to shell 12 includes gaps 32D and 33D filled by braze material 30D and 31D, respectively. Blade thickness 34 is measured between fluid guiding surface 40D and parallel surface 41D. Angle 36 is measured between surface 40D and shell 12. As can be appreciated from the FIG. 9D, gap 33D in FIG. 9D is less than gap 133 in FIG. 4 for blade 16D with thickness 34 equal to thickness 134 and angle 36 equal to angle 136.

Although the foregoing descriptions referred to gaps and angles with respect to shell 12, it can be appreciated that the same gaps and angles are present in and the methods described for reducing the gaps would be equally applicable to the joint between blade 16 and shell 14. As stated supra, shell 12 may be an impeller shell or turbine shell for the torque converter, while shell 14 may be a core ring for the torque converter. Blade tabs 24 joining blade 16 to the impeller shell are typically disposed in indents 22, while blade tabs (not shown) joining blade 16 to the turbine shell and tabs 28 joining blade 16 to the core ring are typically disposed in slots and formed to hold blade 16.

Of course, changes and modifications to the above examples of the invention should be readily apparent to those having ordinary skill in the art, without departing from the spirit or scope of the invention as claimed. Although the invention is described by reference to specific preferred and/or example embodiments, it is clear that variations can be made without departing from the scope or spirit of the invention as claimed.

What we claim is:

1. A blade assembly for a torque converter comprising:
- a shell with an inner surface; and
- a plurality of blades attached to the shell by brazing, each blade in the plurality of blades comprising:
  - a first surface for guiding fluid in the torque converter;
  - a second surface parallel to the first surface, the first and second surfaces defining a thickness for the blade;
  - a coined surface extending from the first surface and substantially parallel to the inner surface; and,
  - a third surface connecting the coined surface to the second surface.

2. The blade assembly of claim 1 wherein a juncture of the third and coined surfaces is about midway through the thickness of said each blade.

3. The blade assembly of claim 1 wherein an angle measured between the first surface and the coined surface is substantially equal to an angle measured between the first surface and the shell.

* * * * *